US006298216B1

(12) United States Patent
McMindes et al.

(10) Patent No.: US 6,298,216 B1
(45) Date of Patent: Oct. 2, 2001

(54) IMAGE TRANSFER DEVICE INCORPORATING A FUSER ROLLER HAVING A THICK WEARABLE SILICONE RUBBER SURFACE

(75) Inventors: Michael McMindes, Rochester; James Montgomery, Bergen; Eric Stypa, Hamlin, all of NY (US); Michael Goretzky, Eching (DE); Gerhard Loedermann, Munich (DE); Franz Wittmann, Isen (DE)

(73) Assignee: Ten Cate Enbi, Inc., W. Henrietta, NY (US)

( * ) Notice: Subject to any disclaimer, the term of this patent is extended or adjusted under 35 U.S.C. 154(b) by 0 days.

(21) Appl. No.: 09/400,214

(22) Filed: Sep. 21, 1999

(51) Int. Cl.[7] ..... G03G 15/20
(52) U.S. Cl. ..... 399/330; 399/333
(58) Field of Search ..... 399/333, 328, 399/330; 492/46, 56; 428/36.8

(56) References Cited

U.S. PATENT DOCUMENTS

| | | | |
|---|---|---|---|
| 4,887,964 | 12/1989 | Takeuchi . | |
| 5,035,950 | 7/1991 | Del Rosario . | |
| 5,049,943 | 9/1991 | Menjo et al. . | |
| 5,227,853 | 7/1993 | Proulx et al. . | |
| 5,520,600 | 5/1996 | Fukumoto . | |
| 5,530,536 | 6/1996 | Henry et al. . | |
| 5,534,347 | 7/1996 | Chen et al. . | |
| 5,547,759 | 8/1996 | Chen et al. . | |
| 5,568,241 | 10/1996 | Creutzmann et al. . | |
| 5,582,917 | 12/1996 | Chen et al. . | |
| 5,629,061 | 5/1997 | Kass . | |
| 5,697,037 * | 12/1997 | Yano et al. | 399/333 |
| 5,709,949 | 1/1998 | Chen . | |
| 5,716,714 | 2/1998 | Chen et al. . | |
| 5,722,026 * | 2/1998 | Goto et al. | 399/333 |
| 5,782,730 | 7/1998 | Kawasaki et al. . | |
| 5,804,794 * | 9/1998 | Matsuo et al. | 399/333 X |
| 5,837,340 | 11/1998 | Law et al. . | |
| 5,839,038 | 11/1998 | Kopp et al. . | |
| 5,851,673 | 12/1998 | Chen et al. . | |
| 5,906,881 | 5/1999 | Chen et al. . | |
| 5,950,061 | 9/1999 | Ota et al. . | |
| 5,987,295 * | 11/1999 | Matsuo et al. | 399/333 X |
| 6,005,594 * | 12/1999 | Nanataki et al. | 399/333 X |
| 6,072,156 * | 6/2000 | Matsuo et al. | 399/333 X |

FOREIGN PATENT DOCUMENTS

| | | |
|---|---|---|
| 0 313 023 | 4/1989 | (EP) . |
| 0840 179 A1 | 5/1998 | (EP) . |
| WO 91/19352 | 6/1991 | (WO) . |

OTHER PUBLICATIONS

The World of Printers, The Technologies of the High Performance Printers of Oce' Printing Systems GmbH, Non–Impact Printing Technologies, Nov. 1998, Edition 3a, Germany.

Dow Conrning Corp., Information About High Technology Products, Silastic E RTV Silicone Rubber, 1993, Midland, Michigan.

* cited by examiner

*Primary Examiner*—William J. Royer
(74) *Attorney, Agent, or Firm*—Harter, Secrest & Emery LLP; Brian B. Shaw, Esq.; Stephen B. Salai, Esq.

(57) ABSTRACT

An electrostatographic apparatus and method for fixing toner particles to a receiver, involving the use of a new fusing roller that has a lifetime longer than previous rollers and that rarely, if ever, needs to be cleaned.

22 Claims, 8 Drawing Sheets

IMAGE TRANSFER DEVICE INCORPORATING A FUSER ROLLER HAVING A THICK WEARABLE SILICONE RUBBER SURFACE

FIELD OF THE INVENTION

The present invention relates to a new type of fusing roller for use in high speed web printers.

BACKGROUND OF THE INVENTION

Developed toner images in electrostatographic processes can be transferred and fused to another substrate such as paper. Transfer of the toner image can be accomplished by electrostatic methods, pressure contact, or other means. Once transferred, the toner image can be fused or fixed to the paper. The fusing step commonly consists of passing the paper on which toner powder is distributed in an imagewise pattern, through the nip of a pair of rolls, at least one of which is heated. The heated roller is often referred to as a fusing roller.

Toner fusing rollers have a cylindrical core which may contain a heat source in its interior, and a resilient covering layer formed directly or indirectly on the surface of the core. Roller coverings are commonly fluorocarbon polymers or silicone polymers, such as poly(dimethylsiloxane) polymers, of low surface energy which minimizes adherence of toner to the roller.

One persistent problem in this operation is that when the toner is heated during contact with the fusing roller, it may adhere not only to the paper but also to the fusing member. Any toner remaining adhered to the member can cause a false offset image to appear on the next sheet and can also degrade the fusing roller. Any toner or dirt stuck to the roller should be easily removable.

In the past, fusing rollers often had to be cleaned several times before their useful life ran out. This meant that printing time was wasted while somebody physically opened the machine and wiped down the fusing roller. In the case of the high-speed reel paper printers like the one we have described below, the fusing rollers had to be cleaned once every 25,000 copies. This meant that every 2 days or so, the printers had to be opened and the fusing rollers cleaned.

Frequently release oils composed of, for example, poly (dimethylsiloxanes), are also applied to the roller surface to prevent adherence of toner to the roller. Such release oils may interact with the roller surface upon repeated use and in time cause swelling, softening and degradation of the roller. Silicone rubber covering layers which are insufficiently resistant to release oils and cleaning solvents are also susceptible to delamination of the roller cover after repeated heating and cooling cycles. For the high speed printers, every 2 weeks or so the fusing roller needed to be replaced. This also cost more time and money.

SUMMARY OF THE INVENTION

The object of the invention is design for, and a method of using an electrophotographic printer for reel paper that utilizes a new type of fusing roller that has a lifetime of 2 million copies and is self-cleaning. The fusing rollers as used in the printer has needed little to no cleaning, and had experimental lifetimes of up to 2.4 million pages.

It should be noted that these thicknesses were for printer speeds of between 120 and 500 pages of A4 paper per minute. At slower speeds, thicker outer layers should be considered.

These objects of the invention are achieved with an electrophotographic printer for reel paper having: a print transfer station with integrated paper transport device for transferring onto the reel paper a toner image which is produced on an intermediate carrier and inked; an electro-thermal fixing station, which is arranged downstream of the print transfer station in the transport direction of the paper, for the toner image with an electrically heated fusing roller driven by an electric motor, a feed roller which can be pivoted onto and away from the fusing roller in a fixing area and an unheated paper guide saddle which can be pivoted onto and away from the fusing roller and by means of which the reel paper is guided around the fusing roller at a wrapping angle which can be predetermined by the pivot position of the paper guide saddle for the purpose of preheating before the actual fixing; and a paper brake which is mounted upstream of the fixing station in the transport direction of the paper for making the reel paper taut, as required, between the fixing area and paper guide saddle.

The fusing roller used in this printer offers a much better toner release than prior fusing rolls. This is true in part because of the softness of the roller. The softness of the outer layer is a result of the hardness of the rubber and the thickness of the coating surrounding the core. This coating is comprised of the base cushion layer and the wearable outer release layer. The thicknesses that we found suitable for the coating ranged between 300 $\mu$m and 600 $\mu$m, with a thickness of 500 $\mu$m optimally. To further optimize the superior functionality of this coating, this coating is divided equally between base layer and surface layer The present invention relates to use of a new fusing roller design in image transferring devices such as printers and copiers. In particular, devices similar to those covered by patents U.S. Pat. Nos. 5,839,038 and 5,568,241. The disclosures of these patents are hereby incorporated by reference to the present disclosure.

The present invention is a copier with a new fusing roller that has a much longer lifetime than those in the prior art. The fusing roller is also self-cleaning. This roller works particularly well in OPS's web printer. The printer it is used in allows the web of paper to pull itself off the fusing roller upon exit. The toner is presoftened prior to entering the fuser nip and then the web pulls itself off the fusing roller.

DETAILED DESCRIPTION OF THE PREFERRED EMBODIMENT

Figure 1:
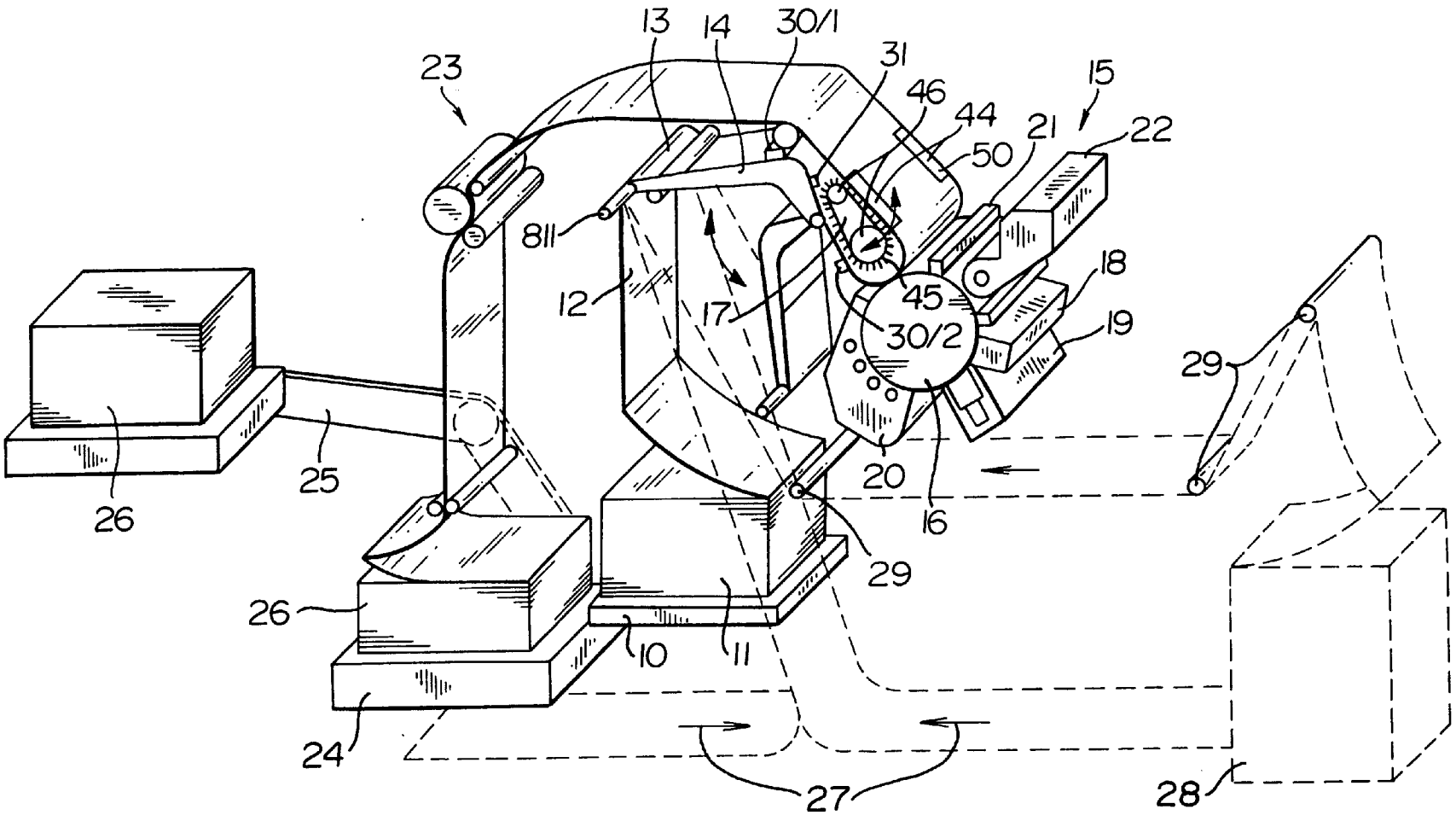
FIG. 1 shows a diagrammatic basic view of the paper guide in an electrophotographic printer.

In the following paragraphs, I have used the term paper generally for toner receivers. It will be apparent to those with skill in the art that other materials such as textiles, plastics, etc. are equivalent to paper for the purposes of this invention.

The invention is an apparatus incorporating, and a method for using, a new fusing roller in an electrophotographic printer for reel paper. The design of the fusing roller, gives it desirable properties when used in reel paper printers such as that described below. This fusing roller has a much longer lifetime than prior fusing rollers used in such printers. This roller also has self-cleaning properties.

A printer which operates according to the principle of electrophotography has a supply table 10 for receiving a supply stack 11 of prefolded reel paper 12. The reel paper is fed to the actual electrophotographic printing unit 15 via a paper divider device 13 and an actuation rocker 14 which is provided with paper guide elements and can pivot away. This printing unit 15 has a print transfer station 17 which can pivot onto and away from a photoconductive drum 16 and devices which are arranged about the photoconductive drum 16 and are necessary for the electrophotographic process.

In order to generate a toner image on the reel paper, the photoconductive drum 16 which is charged with the aid of a charging device 18 is usually discharged in a character-dependent manner by means of an LED character generator 19 and the charge image generated in this way is inked in a developer station 20 with a developer mixture of toner particles and carrier particles. The toner image is then transferred onto the reel paper 12 in the print transfer station 17. After the transfer, the photoconductive drum 16 is discharged by means of a discharge station 21 and cleaned in a cleaning station 22 and recharged by means of the charging device 18.

Instead of the electrophotographic process described, it is also possible to generate the toner image on the reel paper 12 by using for example an electrostatic process or a magnetic process or even an ink comb which applies ink directly onto the reel paper.

The paper web 12 provided with a toner image is then fixed chemically or by means of heat in a fixing station 23 and deposited on a deposit table 24. In the illustrated exemplary embodiment of the printer, the deposit table 24 is designed so as to pivot out by means of a pivot lever 25 in order to make it easier to remove the printed paper stack 26.

If the printer is coupled for example to a further printer in order for example to permit printing on the front and rear sides, the paper web 12 can also be fed directly to the paper divider device 13 by external paper feed channels 27. In addition, it is possible to use an external reel paper supply stack 28 as supply stack. In this case, separate paper feed elements with paper rollers 29 may be necessary to feed the paper web.

Figure 10:
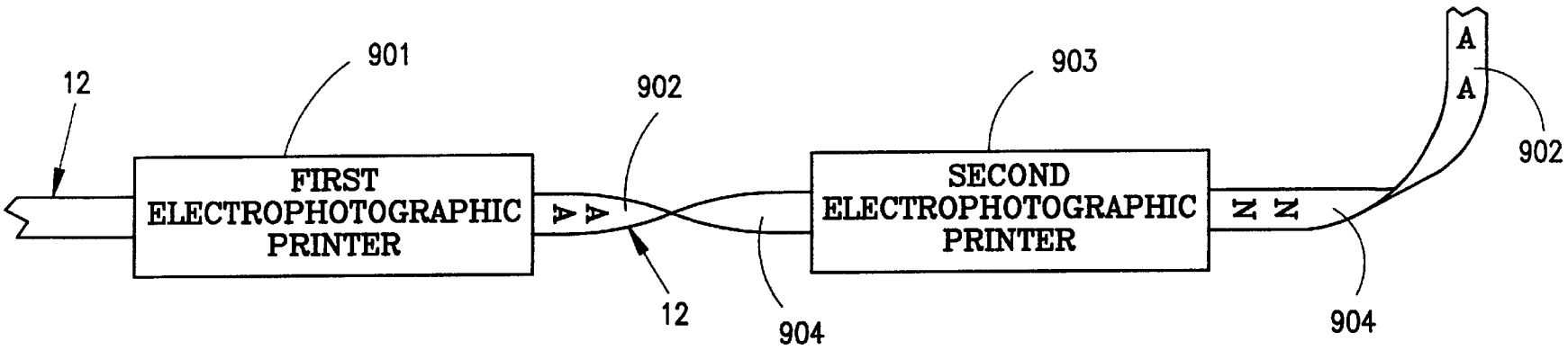
FIG. 10 schematically depicts the formation of a fixed toner image on a rear side of the reel paper by a first electrophotographic printer and the formation of an additional toner image on a front side of the reel paper by a second electrophotographic printer.

FIG. 10 depicts a first electrophotographic printer 901 that receives reel paper 12. The first electrophotographic printer 901 prints a fixed toner image on a rear side 902 of the reel paper 12. A second electrophotographic printer 903 forms an additional toner image on a front side 904 of the reel paper 12.

In order to prevent particles such as paper clips or other metal parts which damage the photoconductive drum 16 getting into the print unit 15, a particle trap 30/1, 30/2 is arranged either at the entry area to the print transfer station 17 or integrated in the print transfer station. The printer also has a paper insertion device which can be actuated via the actuation rocker and has an associated paper brake 31.

The aforesaid devices of the printer are now described in detail:

In order to separate from one another paper layers of the reel paper web 12 pulled off the stack 11 which are sticking to one another, a paper divider device 13 (FIG. 2) is arranged above the paper stack 11 at the entry of the feed channel to the printing unit 15. This paper divider device contains a first deflection element in the form of a rotatably mounted paper roller 32 which is arranged between two side parts 33 of the actuation rocker 14 at its free pivot end. In addition, it contains a second deflection element in the form of a motor-driven paper roller 34 which is arranged in a stationary position on two carrier elements 35 which are securely connected to the housing of the printer. The motor-driven paper roller 34 is located here in the pivot region of the actuation rocker 14. Arranged above the first deflection element (paper roller 32) there is a paper guide element 36 at a distance which forms a passage for the paper web. The paper guide element is constructed in such a way that together with other plate elements it forms a collecting basket 38 for the first stripped-off folding sheet of the paper web.

In the operating position (position B), i.e. with the actuation rocker 14 pivoted up, the reel paper web 12 is initially guided in a first deflection direction by means of the first deflection element 32.

A first paper layer 37 which adheres to, in relation to the paper roller 32, the outside of the paper web is stripped off with its folding edge from the paper guide element 36 and is forced into the collecting basket 38. As it is transported further, the first paper layer 37 is fanned out. A second paper layer which adheres to, in relation to the paper roller 32, the inside is guided by the paper web 12 about the paper roller 32 with the first deflection direction and then, as a result of the deflection at the second deflection element (paper roller 34), is released from said element and drops downwards. This also leads to the paper layer being fanned out so that a spread out, unfolded reel paper web 12 is available for further transport via a paper guide element 40 arranged between the side parts 33 of the actuation rocker 14.

The actuation rocker 14 not only forms a component of a paper divider device 13 but is also an essential functional element of a paper insertion device for the insertion of the reel paper 12 into the printer. In order to permit the reel paper to be inserted, the actuation rocker 14 is mechanically coupled to the print transfer station 17 in such a way that when the actuation rocker 14 is pivoted out of a loading position A into an operating position B the print transfer station 17 is pivoted onto the photoconductive drum 16 or pivoted away in the case of pivoting from position B into position A.

For this purpose, the actuation rocker 14 is rotatably mounted, by means of mounting elements 42, in the region of the print transfer station on an axle 41 which is fixed to the frame. The print transfer station itself is also pivotably mounted on an axle which is fixed to the frame. The print transfer station contains a tractor drive with two tractor belts 44 which engage laterally in the edge perforations of the reel paper 12 and have transport nipples 45 arranged thereon. The tractor belts 44 are guided and mounted on two drive wheel pairs 46 which are connected to one another via axles, the drive of the tractors taking place via a motor M (FIG. 2) which is coupled to the large drive wheel pair. While the reel paper 12 is being transported, it is located, viewed in the transport direction of the paper, both in front of and behind the print transfer area of the print transfer station, by means of its perforation holes, in engagement with the tractor belts 44. Four transport flaps 50 which press the reel paper against the tractor belts 44 in the region of the perforation holes are provided as securing and guide elements for the reel paper.

In order not to smudge the toner image on the paper web during the pivoting away of the print transfer station with the paper web inserted, the print transfer station 17 is mounted, with respect to its pivot, in such a way that the paper guided in the print transfer area of the print transfer station 17 is immediately lifted away from the photoconductive drum without sliding there.

In the operating position (position B) with the actuation rocker 14 pivoted up, the print transfer station 17 is pivoted onto the photoconductive drum 16 and paper guide elements expose the print transfer area. If the actuation rocker 14 is pivoted in to position A, a paper deflector is guided into the area between the photoconductive drum and print transfer station and a widened paper guide channel opens between the print transfer station 17 and paper element. In this arrangement, the paper guide element protects the photoconductive drum 16 in the print transfer area from the entry of light and from damage.

In the paper transport direction upstream of the print transfer station 17 a paper insertion plate 68 is securely arranged which interacts with a round paper guide area 69 of the actuation rocker 14. The paper guide area 69 serves as paper deflection element for the paper web.

In position A of the actuation rocker 14, the reel paper 12 can now be guided without difficulty via the paper guide area 69, the paper insertion plate 68 and paper guide element of the print transfer station 17 around the print transfer station 17 and inserted into the power output-side tractor belt.

A paper guide channel 80 is provided arranged downstream above the print transfer station 17 in the transport direction of the paper. This paper guide channel 80 is composed of a plane cross member 81 with a cover plate covering the width of the paper web and a wall plate 82 arranged at a distance therefrom. At the entry to the paper guide channel is a paper guide plate 84 (paper guide flap) which can be pivoted about the axis 83 counter to the force of a spring (not illustrated here). The paper guide plate has the function of a loop retractor and serves as paper length buffer in order to compensate different paper transport speeds between the print ransfer station 17 and fixing station 23 caused by mechanical tolerances, different types of drive (friction drive tractor drive) etc., and also as sensor for the paper transport speed. The position of the paper guide flap 84 is sensed via two sensors 84/1 and 84/2 and the drive of the fixing station 23 is controlled as a function thereof. If for example the drive of the fixing station is faster than that of the print transfer station 17, the lower sensor 84/2 is actuated and the fixing station 23 braked. If the print transfer station 17 is slower than the fixing station, the paper flap 84 is moved out to a greater degree and this excursion detected via the sensor 84/1.

In the paper guide channel 80, there is also arranged a suction chamber 85 which extends over the entire width of the paper guide channel and interacts with a device (not illustrated here) which generates underpressure. The suction chamber has the function of a paper brake in order to be able to reliably brake the paper when the paper transport is interrupted and in order to ensure a uniform paper retaining force during transport through the fixing station.

Instead of a suction chamber as a paper brake, any other type of paper brake which is controllable, for example by means of a mechanical deflection point or a braked pin wheel which engages in the edge perforations of the reel paper 12, can also be used.

The paper guide channel 80 guides the paper to the fixing station 23. The fixing station 23 is constructed as a thermal fixing station. It consists of a fusing roller 86 heated via radiators and of a feed roller 87 which can be pivoted, driven by an electric motor, onto the fusing roller 86 and away from it via a cam 87/1. In addition, it has an oiling device 88 which serves to apply lubricant to the fusing roller 86 and possibly to clean the fusing roller. The oiling device 88 has an oil pan 89, the one side wall of which serves as paper guide element for the reel paper. A cooling profile 90 through which air flows in order to conduct away heat is located below the oil pan 89 of the oiling device. In addition, arranged below the fusing roller and the feed roller is a run-out roller saddle 91 on which paper rollers are arranged and which serves to pass on the reel paper after fixing. Arranged between the fixing station with fusing roller 86 and feed roller 87 and the paper guide channel 80 is a paper guide saddle 93 which can be pivoted about an axis 92 and can be pivoted onto the fusing roller 86 and away from it with the aid of a cam 94, which is driven by an electric motor, irrespective of the position of the cam. The cam 94 basically enables the paper guide saddle 93 to assume three positions. These positions are identified by AP, BP and CP. In position AP, the paper guide saddle 93 is virtually pivoted onto the fusing roller 86. This represents the operating position or printing position. In this printing or operating position, the reel paper is guided around the fusing roller 86 at a wrapping angle designated by U. The feed roller 87 is pivoted onto the fusing roller 86. The wrapping angle U can be controlled in accordance with the pivot position of the paper guide saddle controlled by the cam 94. In one position BP, the paper guide saddle 93 is in a loading position. It is pivoted away at a distance from the fusing roller 86, the distance being dimensioned in such a way that in this state the reel paper can be easily guided through the fixing station without coming into contact with the fusing roller 86. In this loading position, the feed roller 87 is additionally pivoted away. In this way, a paper conveying channel through the fixing station is formed by means of the paper guide saddle and the fixing station in the open state in conjunction with the run-out roller saddle.

Figure 11:
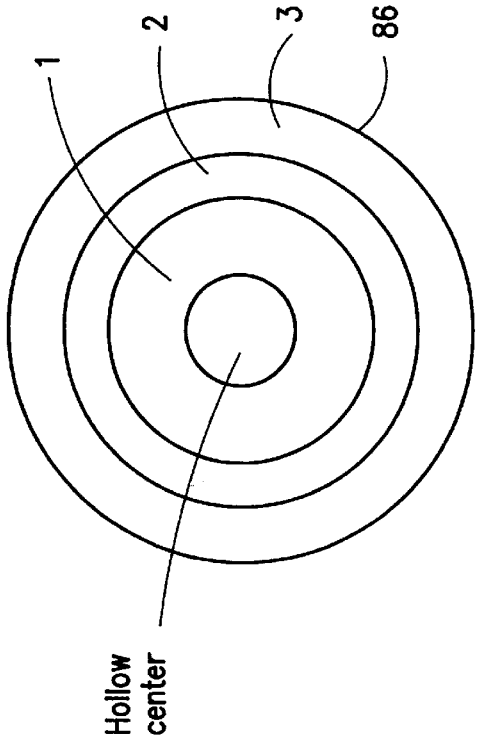
FIG. 11 shows a side view of one embodiment of a fusing roller.

FIG. 11 depicts the preferred embodiment of a fusing roller. The fusing roller illustrated is composed of a core 1, a base cushion layer 2, and an outer wearable release layer 3.

The core 1 is made of hollow aluminum, however, any rigid substrate will suffice for the purposes of this invention. The core may be made out of other metals commonly used for cores, such as steel or nickel. The core of the roller displayed in FIG. 11. is hollow so as to allow a heating element to be inserted into the core. A heating element is used to facilitate the process of setting toner on a sheet of paper.

The core is surrounded by a base cushion layer (or layers) 2 of Dow Corning Silastic 8990, a silicone rubber compound made by Dow Corning located in Midland, Mich. The base layer may be one individual layer or a group of stacked layers. Base cushion layer(s) increase the compliancy of the fusing member. The presently preferred embodiment of the fusing roller system is to have a rather noncompliant fusing roller and a more compliant feed roller. This is relatively speaking. What it means is that the feed roller is the one that deforms to create a nip width into which a toner receiver may be admitted. Silicone rubber compounds are commonly used as base layers in fusing rolls. The base layer is also a good conductor of heat. This is necessary for the heating element inside the core to sufficiently heat the surface.

For the base layer 2, we found that substances with a hardness of between 45 A and approximately 60 A were acceptable. The corresponding thermal conductivity range of these materials should be approximately 0.5–0.7 W/mK. Dow Corning 8990 was one of several materials tested, but Dow Corning 8990 was used because of ease of processing. It should be understood that, even where not explicitly noted, the use of Dow Corning 8990 in a claim includes any substance which is chemically similar to or obvious from the makeup of Dow Corning 8990.

Next, a wearable release layer 3 is distributed on the surface of the base layer. The release layer 3 is made of GE TSE-322, made by GE Silicones located in Waterford, N.Y. It is a trade secret protected one component silicone adhesive sealant that will bond to many substrates without a primer and which will cure rapidly at elevated temperatures. It works well due to its generally poor tensile strength and filler selection, the filler selection generally being silicates. It should be understood that, even where not explicitly noted, the use of GE TSE-322 in a claim includes any substance which is chemically similar to or obvious from the makeup of GE TSE-322.

The wearable release layer has relatively high release and is used optimally in high-speed web printers. Prior art printers do not have a release layer that is as thick as ours with as low a conductivity as TSE-322 has. Previous printers that had thicker release layers were made from materials that were measurably more heat conductive. This was because of internal heating. The heat would have to travel from the core through the layers to the surface. In the printer the fusing roller was tested in this is not necessary because the paper is in extended contact with the fusion roller.

Method for constructing roller:

First, start with a tubular core. The core is grit-blasted. This is done to remove the oxidized surface so that it reacts better with the primer. Aluminum is used because it is both highly heat conductive and low cost. Other metals that conduct heat well would make good core materials for internally heated rollers.

Next, the surface of the core is cleaned with a solvent to prepare it for a layer of primer. The solvent used for the present roller was toluene. After the core is cleaned, a layer of primer is applied. The primer layer helps the base layer adhere to the metal core. Dow Corning Toray DY-39-051 has been used in the manufacture in successful early rollers. However, it was determined that Dow Corning P5200 works better and the cores are now primed with that. If the material chosen for the base layer contains primer, is self-priming, then this step may be left out.

Next, we apply the base cushion layer. In the present case the base cushion layer was composed of Dow Corning Silastic 8990. It is applied to the core via a blade or ring coating process. It is then cured in a convection oven for 45 minutes at 150 C.

After exiting the oven, the roller is ground down to maintain its size and concentricity, and to remove the cured skin surface to promote interlayer adhesion. The roller is cleaned using a solvent. Once again, toluene was the solvent chosen for this purpose.

A top coat of wearable release material is then applied. We used GE/Toshiba Silicone TSE-322. The TSE-322 is first mixed with toluene in a 1:1 ratio to facilitate spraying. It is then applied to the base cushion layer via a spray process. The roller is then allowed to sit for 30 minutes at room temperature. This allows the residual solvent to evaporate.

The top coat is then cured for 1 hour at 150 C., after which it is post-cured in a convection oven for 4 hours at 200 C. It is then ground down again to maintain the size and concentricity of the roller, as well as the roughness of the surface. Also, the grinding process removes the cured skin. This helps to provide consistent surface characteristics as the roller wears.

Finally, the roller is coated with silicone oil. In this case, the oil used was AKF1000 silicone oil from Wacker Chemie in Burghausen, Deutschland. The oil had a viscosity of 10,000 cst. It is estimated that a viscosity of at least 500 cst is necessary for good results, however no tests have been done. The roller is then baked for 30 minutes at 150 C. This preconditions the roller to machine conditions.

The further pivoted-away position CP of the paper guide saddle 93 defines the so-called standby position. This is the position in which the paper web is completely exposed. This position is assumed when the printing operation is interrupted.

The pivotable deposit table 24 for receiving the printed reel paper is assigned downstream of the fixing station 23 in the transport direction of the paper. In order to be able to securely deposit the reel paper on the deposit table 24, a stacking device 99 is arranged. This stacking device can be pushed into its position in relation to the deposit table 24 with the aid of a drive device 101 (electric motor). It contains funnel-shaped insertion profiles 95 which serve to receive the reel paper in the raised state of the stacking device and to reliably feed the paper which is guided via the run-out roller saddle 91 to two paper transport rollers 96 driven by electric motor. The paper transport rollers 96 are customary paper rollers with a rubber coating.

A paper guide channel 97 which is formed by guide baffles is arranged downstream of the paper transport rollers 96, a sensing device 98 for the reel paper being arranged in the paper guide channel 97. The sensing device is constructed as a customary photoelectric beam. The stacking device 99 also has paddle shafts 100 for securely depositing the reel paper 12.

A microprocessor-controlled drive arrangement D (FIG. 2) is provided to drive the different units of the printer, for example the paper transport, the print transfer station, the fixing station and the stacking device 99. The drive arrangement D can be a component of the equipment control C which can be constructed for example in accordance with U.S. Pat No. 4,593,407. The drive arrangement D controls the paper transport during the automatic insertion of the paper and during the printing operation including start/stop operation. It monitors and controls the operation of the different units of the printer, for example the elements of the fixing station 23, the drive of the paper transport rollers 96, the drive of the cams 94 and the tractor drive M (motor) of the print transfer station 17. In addition, it detects a multiplicity of input signals, for example the sensing signal of the sensing device 98 or a switch 120 which senses the position of the actuation roller 14, and the position of the sensors 84/1 and 84/2.

Figure 2:
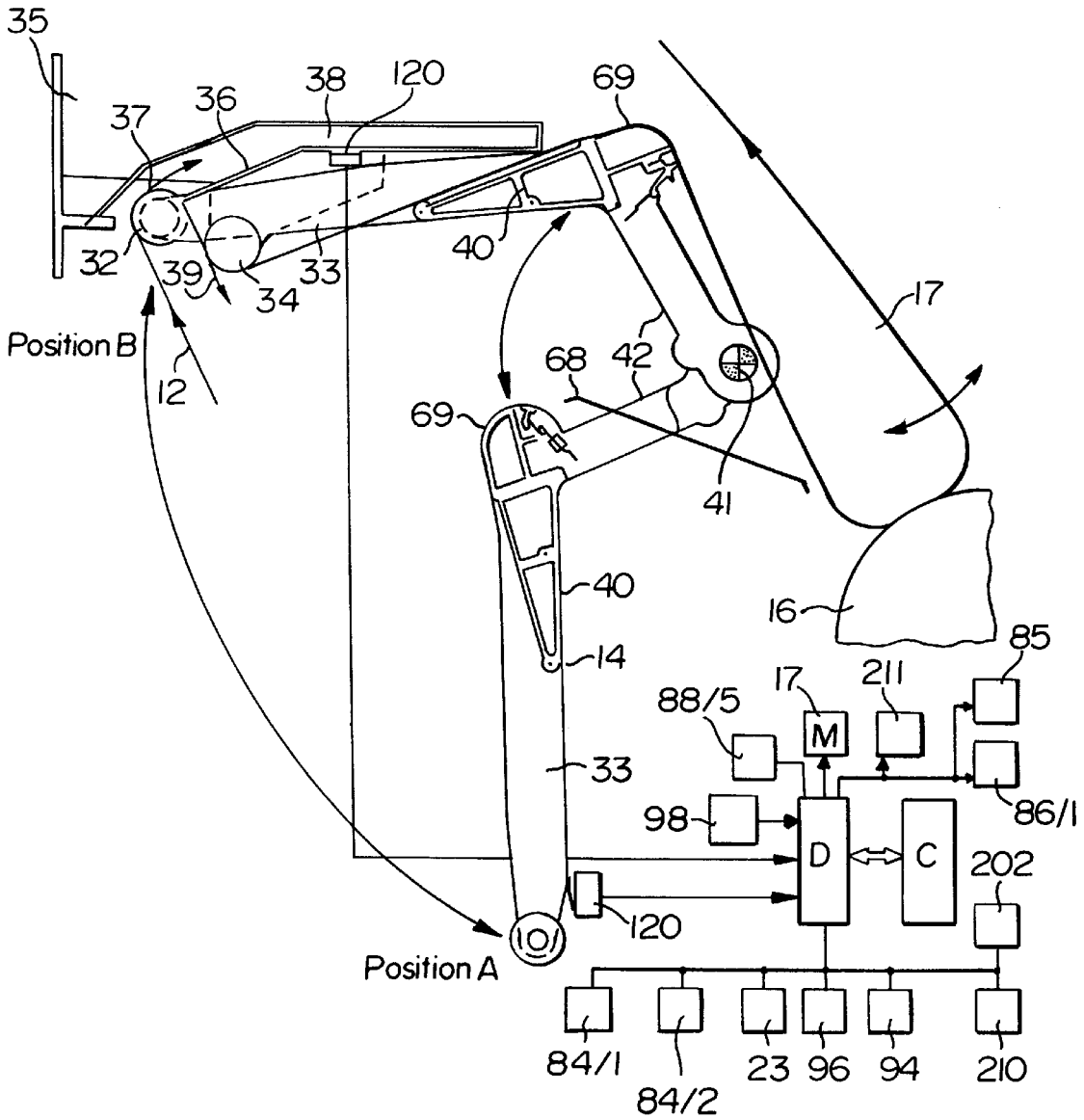
FIG. 2 shows a paper divider and insertion device for reel paper in the operating position (position B) and in the pivoted-away state (position A) with a control arrangement controlling the paper path.
Figure 3:
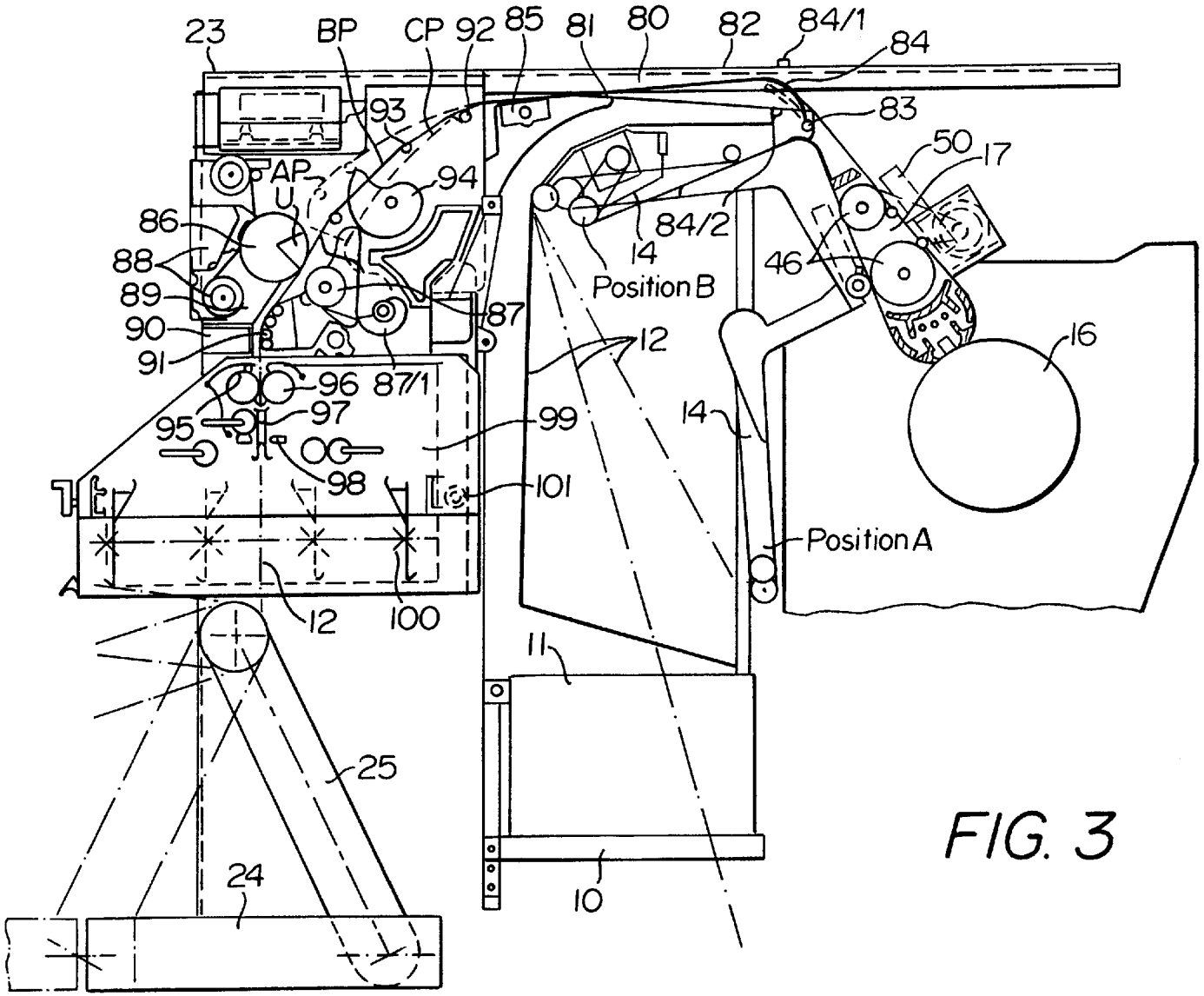
FIG. 3 shows a diagrammatic view of the paper guide with the associated units in an electrophotographic printer.

The operation of the electrophotographic printer is now explained in greater detail with reference to various operating states:

Insertion of the reel paper into the printer:

After the paper stack 11 is inserted on the supply table 10, the actuation rocker 14 is pivoted into position A via a handle 81. This position is sensed via the switch 82 (FIG. 2). The print transfer station 17 is pivoted away and paper guide elements cover the photoconductive drum 16 and open a wide paper insertion channel. The paper can be guided by this paper insertion channel through the printing station and be suspended in the power output-side tractor belts 44. In this case, they are suspended in such a way that the end of the first sheet comes to rest on the flap of the paper guide plate 84 acting as loop retractor. Thus, the first sheet of the reel paper is situated in the pull-in area of the paper guide channel 80. Afterwards, the transport flaps of the power output-side tractor belts are closed. Now, the actual insertion procedure controlled by the drive arrangement D begins.

This begins initially by the closing of the actuation rocker 14. This closing process is sensed via the switch 82 and a slow crawling speed operation of the reel paper 12 is triggered which serves to thread in the paper in an accurately positioned manner with its edge perforation into the transport nipple 45 of the tractor belts 44.

If the actuation rocker 14 is closed, this position is sensed by a further switch 120 and the drive arrangement D is informed of this. The paper web is now guided through the paper divider device 13 and the actual automatic insertion of the reel paper into the fixing station 23 begins.

Automatic threading through of the reel paper through the printer:

In addition, the reel paper is pushed at crawling speed via the cover plate of the cross member 81 which is situated between the print transfer station 17 and fixing station 23 and via the suction chamber 85. During the further threading through, the paper guide saddle 93 is placed in the loading position B by means of the drive arrangement D via the cam 94. In this way, a paper guide system which is inclined at approximately 60.degree. and is suitable, with the aid of the further paper transport advance through the print transfer station 17 and utilizing the natural gradient path, for moving the reel paper through the insertion profiles 95 into the area of the paper transport rollers 96 (pulling rollers) of the stack 99 which is positioned tightly under the fixing station 23 is produced in the fixing station 23, formed from the elements paper guide saddle 93, oiling pan 89 and cooling profile 90.

After the paper transport rollers 96 of the stacking device 99 have gripped the reel paper, it is transported on as far as the sensing device 101 of the paper guide channel 97.

The drive arrangement D switches the further paper transport off and moves the paper guide saddle 93 into the standby position CP. As a result, a loop of the reel paper is produced. The paper length which becomes free in this process is transported out by means of the paper transport rollers 96 which are subsequently switched off.

Operation of the Fixing Station During Printing

Figure 5:
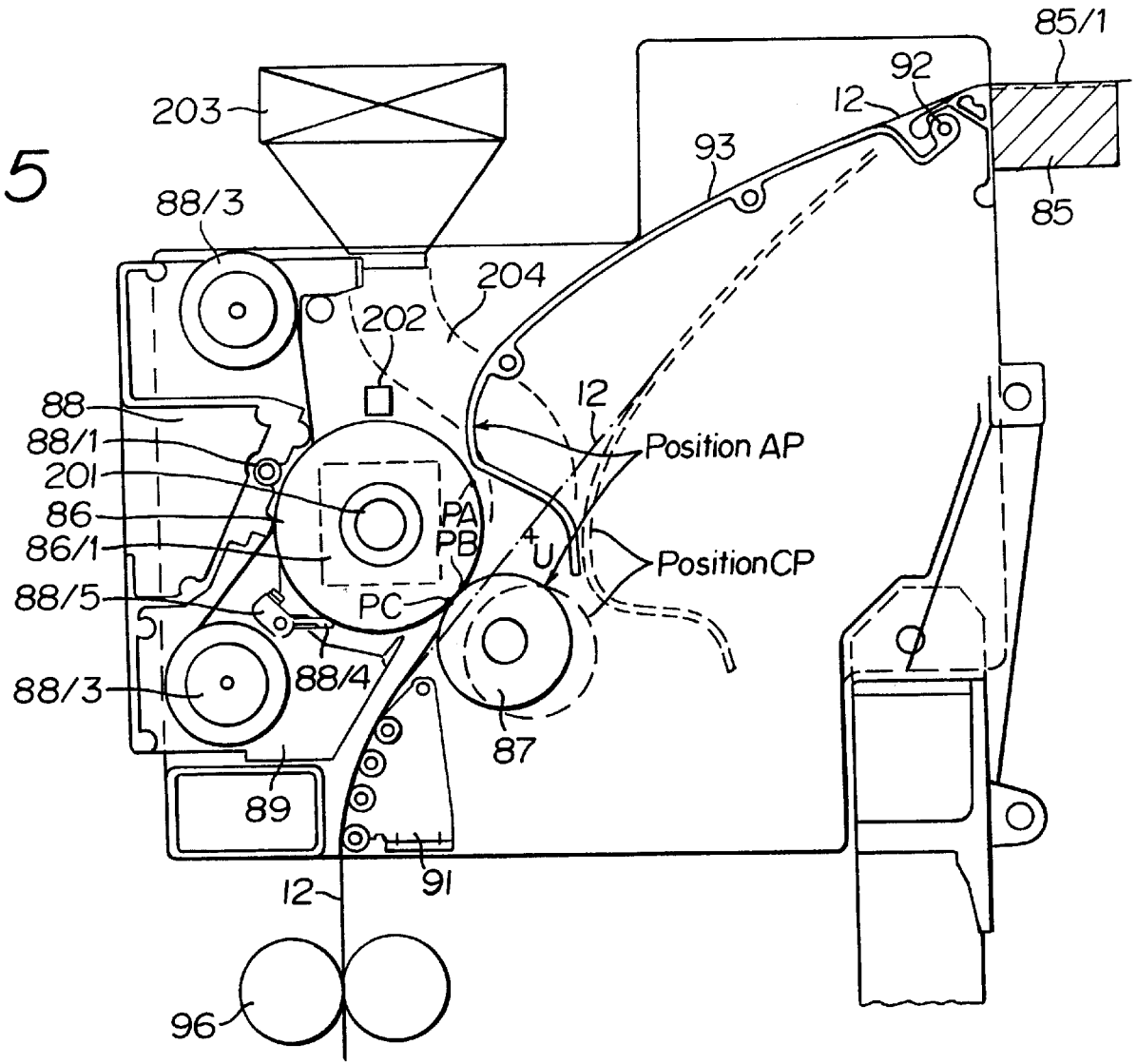
FIG. 5 shows a diagrammatic view of the fixing station of an electrophotographic printer in different operating states.

General (FIG. 5)

In the thermal fixing station 23, the reel paper 12 and the toner image located on the reel paper 12 are guided through under pressure between two rotating rollers, namely the fusing roller 86 and the feed roller 87, the fusing roller 86 being heated. In order to achieve a required adequate adhesion of the fixed toner image on the reel paper 12, it is necessary for the toner particles to be heated beyond their melting point and to coalesce and for the melted toner particles to be bonded to the paper structure. If, for example, toner on a polystyrene butyl methacrylate base is used, this occurs, as shown by tests, when the paper temperature is greater than 110.degree. C. Instead of polystyrene butyl methacrylate toner it is also possible to use toner on a polyester base. The material used for the recording medium is usual EDP paper.

With increasing paper speed in the fixing station, the heating time of the paper web, and thus also the achievable paper temperature, is reduced. At higher paper speeds, usually greater than 350 mm per second, the required paper temperature can no longer be reached without additional heating of the paper web, especially when large paper basis weights, for example of 160 gr per square meter and larger, and papers with a high water content have to be fixed. The water content in the paper can be up to 10 percent by weight. In order to be able to fix at high paper transport speeds it is therefore necessary to adequately preheat the paper before the actual fixing in the fixing gap between the fusing roller and feed roller. In accordance with the illustration in FIG. 5, the paper web 12 is therefore wrapped around the fusing roller 86 at a wrapping angle U to such an extent that a sufficiently long section is available for heating up the paper web. This wrapping angle U depends on the one hand on the surface temperature of the fusing roller 86 and on the transport speed of the paper. The fusing roller 86 is heated via a radiator module 201 in the form of several halogen radiators arranged in the center of the fusing roller 86, the surface temperature of the fusing roller 86 being detected via temperature sensors for the fusing roller temperature 202 arranged on the circumference of the fusing roller. The temperature of the fusing roller 86 is controlled via the drive arrangement D, specifically as a function of different operating parameters by switching the radiator module 201 on and off.

The wrapping of the paper web U around the fusing roller 86 is carried out by means of the pivot saddle 93 (paper guide saddle) which is not heated and which is therefore at the room temperature of the equipment. The paper web is guided via this pivot saddle and then lays itself around the fusing roller 86 in accordance with the wrapping angle U. When the printing operation starts, the pivot saddle 93 is pivoted away from the position CP (standby) into the operating position AP.

As a result, the paper web 12 comes to rest against the fusing roller 86. The point PA designates here the first contact point of the recording medium 12 with the fusing roller 86. At the point PB the preheating ends and the actual fixing gap begins which extends as far as the point PC. The length of the fixing gap between point PB and PC is dependent on the pressure force of the feed roller 87 against the fusing roller 86, the feed roller 87 being covered at the circumference with an elastic material so that the feed roller 87 becomes flattened in the fixing gap area. The distance between the point PA and point PB on the fusing roller defines the actual preheating area.

While the paper web moves from point PA to point PB, i.e. in the preheating area, it lies against the fusing roller 86 made taut by the underpressure brake 85 (suction chamber). By means of this tightening of the paper web by the underpressure brake 85 a good thermal contact between the paper web and the fusing roller 86 is produced in the wrapping area. After the point PB is reached, the preheating of paper and toner image is terminated. Subsequently, the slightly pasty toner is rolled, under pressure and heat, into the paper structure in the region of the fixing gap (distance PB to PC). The fixing gap (radian measure between PB and PC) must be elected to be of such a size that the paper web is at a temperature of more than or at least equal to 110.degree. C. after it leaves the point PC. In this process, the paper speed and the fusing roller surface temperature are predetermined. With the described toner material and recording medium material, in the illustrated exemplary embodiment a wrapping angle U of the paper web about the fusing roller of 60.degree. is obtained, as a result of the paper speed of 487 mm per second and a fusing roller temperature of 220.degree. C.

This type of paper web preheating permits a cost-effective and space-saving design of the fixing station, in which case it is also possible to fix a toner image on a paper web which already has a fixed printed image on the rear. Therefore, the described fixing station can be used in electrophotographic printers in which the paper web is printed on both sides. A precondition for the realization of this solution is, however, that no relative movement can occur between the toner image and fusing roller 86 during the stopping and starting process of the paper web. This risk is all the greater the larger the preheating wrapping U of the paper web 12 around the fusing roller 86.

Detailed Description of the Operation of the Fixing Station During Printing

As already described, during printing the paper web 12 moves with the still smudgeable toner image into the fixing station 23 at a virtually constant speed. The cold paper guide saddle 93 (pivot saddle) which is not heated wraps the paper web 60.degree. around the fusing roller 86. In this wrapped area U, the recording medium 12 and the toner image are preheated so strongly that a good fixing quality is achieved after the subsequent fixing of the print in the fixing gap between the fusing roller 86 and feed roller 87. The preheating is required so that the melted-on toner experiences sufficient bonding to the paper structure.

The level of preheating of the paper 12 in the wrapping area U is dependent, inter alia, on the force with which the paper web 12 hugs the fusing roller 86. For this reason, the underpressure suction chamber 85 is located in the paper in-feed area of the fixing station 23. By the generation of underpressure in the underpressure suction chamber 85, the recording medium 12 is pulled against a suction plate 85/1 with through-boles and as a result a friction force is exerted on the recording medium 12. By means of the frictional effect of the feed roller 87 in conjunction with the fusing roller 86 and the retaining force of the suction chamber 85, the paper web 12 is pulled tautly between the fusing roller 86 and suction chamber 85 by means of the fusing roller 86 and the paper guide saddle 93. During preheating and fixing, the cold paper web 12 is heated up and thus heat is constantly drawn away from the fusing roller 86. In order to obtain a constant fixing quality, it is therefore necessary to keep the temperature of the fusing roller surface constant.

For this purpose, the temperature sensors 202 which measure without contact detect the surface temperature and report this to the drive arrangement D in the form of electric signals. The said arrangement compares the measured surface temperature with a predeterminable, stored reference value and controls as a function of this the switching on and off of the infrared halogen radiator module 201 in the center of the fusing roller.

In order to obtain optimum expulsion of the toner particles from the fusing roller surface, silicon oil is applied to the fusing roller 86 with the aid of the oiling device 88. For this purpose, the oiling device 88 has a silicon metering pipe 88/1 which is arranged in a bracket. This pipe is provided with fine metering bores out of which silicon oil is constantly conveyed with a pump and fed from a supply area to a felt element 88/2. The felt element which is steeped in silicon oil is made to pass by the surface of the fusing roller 86 with the aid of a drive device 88/3, which is driven by electric motor, and as a result oils the surface of the fusing roller 86. Since the fusing roller 86 constantly emits silicon oil to the toner image and paper 12 in very small amounts, this consumed silicon oil is conveyed on via the felt element 88/2.

However, the fine pores of the felt element slowly become filled during the fixing process with paper dust toner and gummy silicon oil and thus close up. Therefore, it is necessary to constantly feed new felt to the oiling area of the oiling device 88 from a supply area via the drive 88/3 and to wind up the consumed felt in a wrapping area.

The paper 12 has a very high content of dust. This paper dust would be taken up by the felt 88/2 and produce, together with the silicon oil, a pasty mass which is sporadically entrained by the fusing roller 86 and transferred onto the paper.

In order to avoid this, the felt wrapping speed (felt renewal) would have to be considerably higher. This would result in an unacceptably high consumption of felt. For this reason, a contamination-removing rubber lip 88/4 is arranged between the fixing gap (PB/PC) and the actual oiling area of the oiling device 88, said lip floating on the surface of the fusing roller and scraping off paper dust which it has picked up. With the aid of a pivot device 88/5, the rubber lip is pivoted away under the control of the control arrangement D when printing is interrupted and contamination which has been picked up is thrown into the collection pan 89 lying below it.

The paper can have a very high proportion of water which can be up to 10 percent by weight. Since the paper 12 has to be heated to above 100.degree. C. in the 60.degree. wrapping zone U, some of the water in the paper will also be converted into the vapor state. This steam is extracted from the fixing station 23 by means of a ventilator 203 with associated extraction hose 204.

As already described, the transport of the paper web 12 in the region of the fixing station takes place by means of friction between the fusing roller 86, driven by electric motor, and the paper 12 under pressure from the feed roller 87.

Since the print transfer station transports the reel paper 12 via transport holes (tractor belt 44), as a result of tolerances of the fusing roller diameter, of the transport hole tolerances etc. a difference arises in the paper speeds in the print transfer station 17 and the fixing station 23. This would lead to a tear in the paper or to a looping of the paper between the print transfer station 17 and fixing station 23.

The sensors 84/1 and 84/2 which sense the positions of the paper guide flap 84 ensure that the drive of the fusing roller is controlled as a function of the position of the paper guide flap 84 by means of the drive arrangement D. If the paper guide flap 84 is in an upwardly pivoted-out position with the paper loop pulled, the speed of the fusing roller 86 is increased, under the control of its drive motor, by the drive arrangement D by 1.5% in relation to a normal speed. If the paper guide flap 84 is located in the region of the lower sensor 84/2, the speed of the fusing roller 86 is reduced by 1.5% in relation to a normal speed. The paper transport speed is kept constant in the region of the print transfer station 17 via the tractor drive 44.

In this way, a tear in the paper or an uncontrolled paper loop can arise between the print transfer station 17 and fixing station 23.

The Mechanical Structure of the Fixing Station

Figure 4:
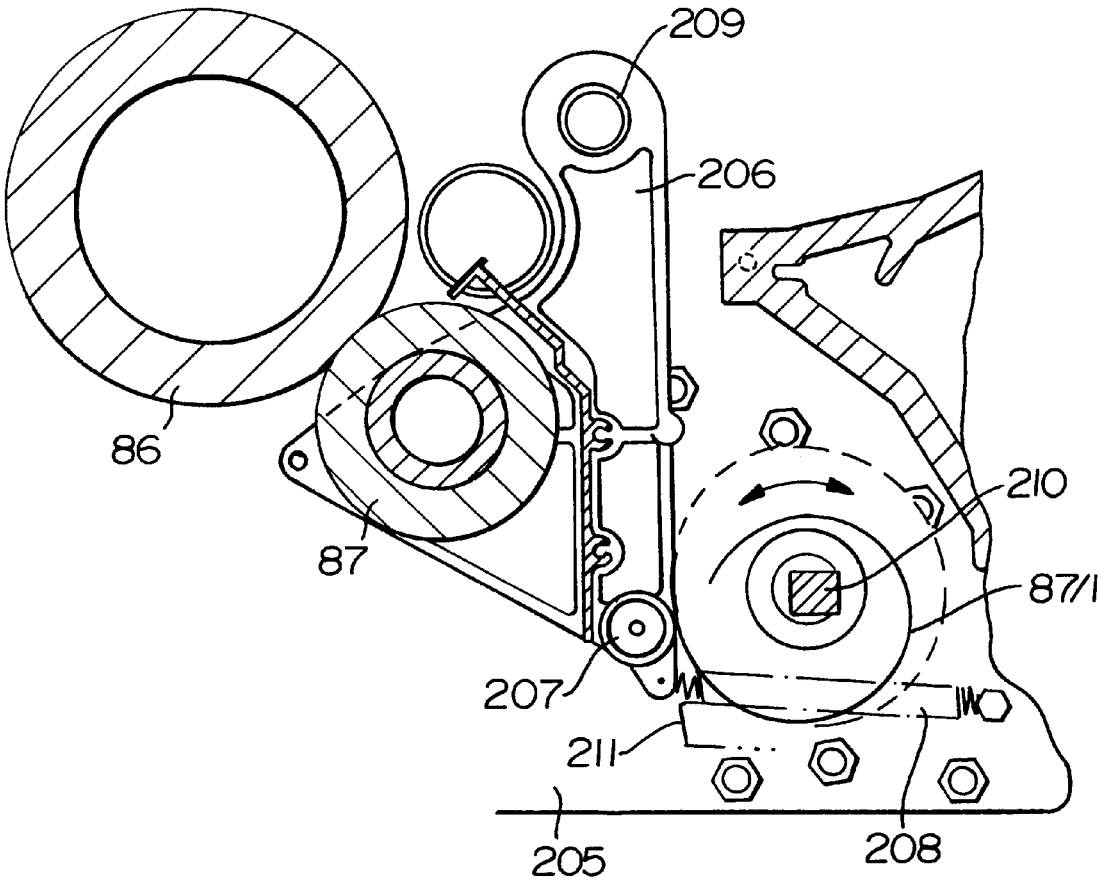
FIG. 4 shows a diagrammatic sectional view of the fixing station of an electrophotographic printer.

The fixing station used in accordance with FIG. 4 contains the fusing roller 86 which is mounted on a frame 205 of the printer and the feed roller 87 consisting of a steel tube sheathed in rubber. The feed roller 87 is mounted on two rockers 206 and can be pivoted onto the fusing roller 86 and away from it (direction of arrow) by means of extensions 207 with the aid of two cam plates 87/1 driven by electric motor. In this process the rockers 206 are pivoted about an axis 209 counter to the force of springs 208. The position of the feed roller 87 on the rocker 206 is sensed by sensing the position of the cam plate 87/1 via a sensor 210 in the form of a Hall generator, arranged on the axis of the cam plates 87/1. The Hall generator (sensor 210) supplies position signals to the drive arrangement D which controls the position of the cam plates 87/1 and thus the contact position of the feed roller 87 via a drive motor 211 (which is only illustrated here diagrammatically) which drives the cam plates 87/1.

Operational Description of the Units of the Paper Transport During Printing

During printing, the print transfer station 17 supplies printed and fixed paper to the fixing station 23 at a constant speed. In the fixing station 23, the paper web is transported under pressure between fusing roller 86 and feed roller 87. Since the speed of the recording medium (paper 12) in the print transfer station and the speed of the paper 12 in the fixing station 23 can never be the same (tolerances due to fusing roller diameter, transport, spacing of perforations etc.), between the fixing station 23 and print transfer station 17 there is a loop retractor in the form of the paper guide flap which can be pivoted on and away counter to a spring force and has sensors 84/1 and 84/2 which are associated with the upper and lower rocking position.

The fusing roller 86 is driven by means of a stepping motor 86/1 which is operated at two exact speeds. One speed produces a fusing roller paper speed which is 1.5% above the desired paper speed of the paper transport determined by the print transfer station 17 and the second speed produces a fusing roller paper speed which is 1.5% below the desired paper speed of the print transfer station 17. If the fusing roller 86 is running at the higher speed, the loop retractor 84 is pulled downwards by the paper web 12 and reaches the lower sensor 84/2 which issues a corresponding drive signal to the drive circuit D. The drive circuit D switches the stepping motor 86/1, and thus the fusing roller 86, to a required lower speed. The loop retractor 84 now moves by means of its own spring, which presses upwards against the paper web 12, until the upper sensor 84/1 is reached. The upper sensor 84/1 in turn issues drive signals to the drive arrangement D which switches over the drive 86/1 of the fusing roller 86 to the required higher speed. This control process carries on continuously.

The unfixed paper web 12 runs from the print transfer station 17 via the loop retractor 84 to the underpressure brake 85 which stresses the paper web 12 tautly over the pivot saddle 93. The latter has the function of wrapping the paper web 12 about the fusing roller 86, for example at an angle of 60.degree. (wrapping angle U) and of offering the paper web 12 to the fusing roller 86 in an exactly guided manner. In the wrapping area between the points PA and PB of the fusing roller 86, the paper web 12 is preheated on the fusing roller 86 with the printed image arranged on it and is subsequently fixed under pressure and heat in the fixing gap between the fusing roller 86 and the feed roller.

The traction rollers 96 arranged beneath the fixing station 23 on the stacking device 99 transport the paper webs 12 onwards onto the stacking table 84 or to a post-processing system, for example a cutting device.

When fixing during continuous printing, the problem of relative movement between paper web 12 and fusing roller 86 does not occur. Thus, smudging and an offset print cannot occur.

Function of the Printer Units Associated With the Transport of the Paper During the Start/Stop Processes of the Paper Web In electrophotographic printers which are used as a high-speed printer together with data processing units, the paper web must be accelerated to a constant speed or delayed again to zero depending on the data supply. This means that the paper web must be brought into contact with the data printed image to be fixed with the hot fusing roller and then removed from contact again.

If this process does not take place with a complete lack of relative movement between fusing roller and printed image to be fixed, smudges of the printed image on the paper can easily occur.

Even very small smudges which are hardly visible with the naked eye can cause parts of the toner image to be transferred onto the fusing roller. These toner particles can then be transferred again onto the paper web in a troublesome manner during the next rotation of the fusing roller. This so-called offset of toner particles from the printed image to the fusing roller is therefore possible because the mechanically intermeshing connection of the toner particles between one another and to the paper structure which was achieved by the electrostatic forces acting during the print transfer process is triggered by the smudging.

In order to obtain as little relative movement as possible of the paper web 12 with the toner image arranged on it as it moves to the fusing roller 86 in start/stop mode, the operation of the units involved in the transport of the paper with their paper transport elements must be exactly matched to one another. This applies in particular to the mutual matching of the print transfer station 17 which determines the transport of the paper and supplies the paper web to be fixed, of the pivot saddle 93 which determines the wrapping angle U of the paper web 12 around the fusing roller 86, of the fusing roller 86 which fixes the toner image on the paper web 12 and transports the paper web 12 as well as of the feed roller 87 which determines the fixing pressure and the friction pressure for transporting the paper web 12.

Figure 8:
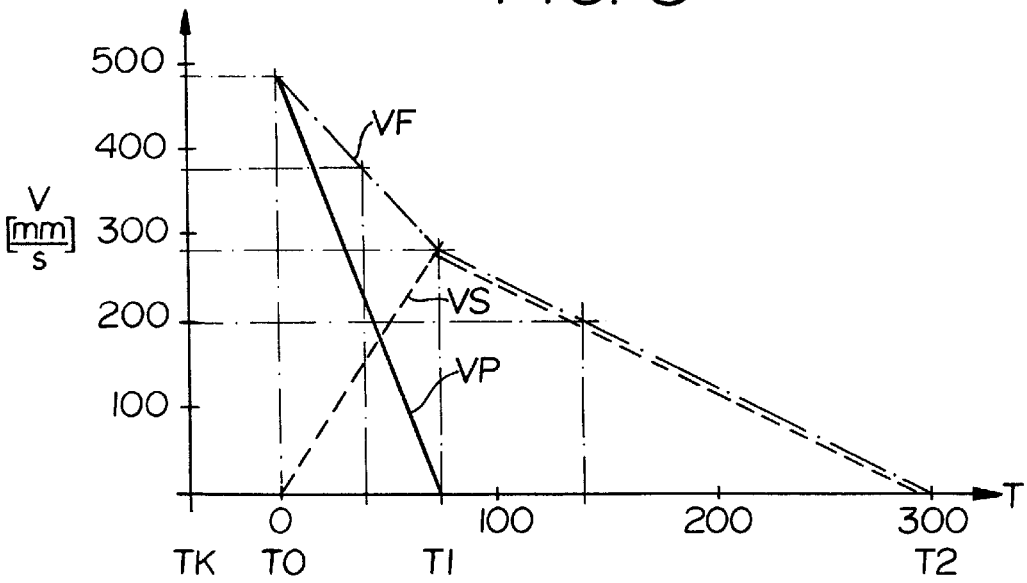
FIG. 8 shows a diagrammatic view of the paper speed V at the various units of the printer as a function of the time T during the stopping process.

Below, the timing of paper transport elements relative to one another during the stopping process is explained with reference to the diagrams in FIGS. 8 and 9. FIG. 8 shows the characteristic of the paper speed V in millimeters per second as a function of time in milliseconds at the print transfer station 17 (continuous curved line) (VP), at the fusing roller 86 (dot-ash line) (VF) and at the pivot saddle 93 (dotted line) (VS).

Figure 9:
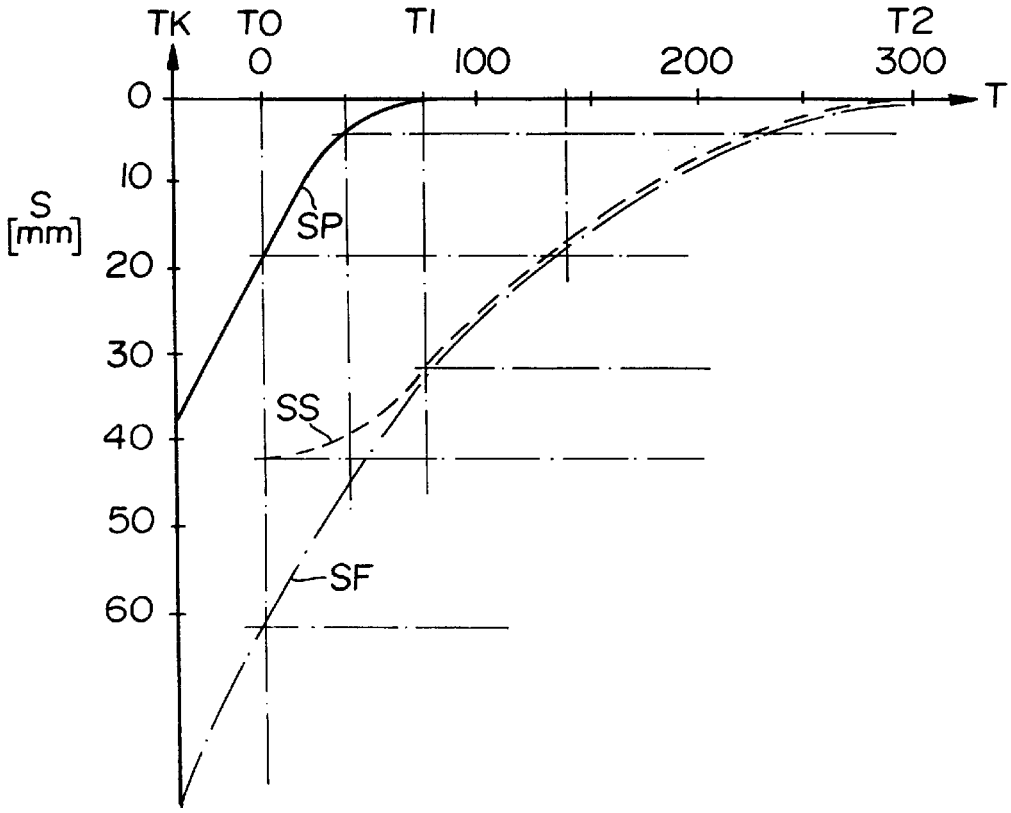
FIG. 9 shows a diagrammatic view of the paper path S of the paper which supplied or transported away by the various units of the printer as function of time T during the stopping process.

FIG. 9 shows in turn the paper path S which is supplied and transported away, respectively, by the individual units of the paper transport, in millimeters against the time T in milliseconds. Here, the continuous line shows the characteristic of the paper path to be supplied by the print transfer station 17 up to the stationary state (SP), the dot-dash line (SF) shows the paper path to be transported away by the fusing roller 86 and the dotted line (SS) shows the paper path supplied by the pivot saddle 93 during the pivoting back of the pivot saddle 93 from the position AB into the position CP during the stopping process.

At the time TK, the paper web 12 is in the state of continuous printing. If no print information is supplied by an EDP system coupled to the printer, the paper web must be stopped at the time T0. This stopping process proceeds as follows: The last page developed on the photoconductive drum 16 is transferred onto the reel paper 12 in the print transfer station 17. When the last possible line of the page has been transferred, the paper web 12 is separated from the photoconductive drum 15 16 and the print transfer station 17 reduces the paper speed to zero, specifically in the time between times T0 to T1. At the same time T0 at which the print transfer station 17 begins to decelerate the paper web 12, the paper speed in the fixing station 23 is reduced by means of the fusing roller 86 and the pivot saddle 93 pivots from the position AB (printing mode) into position CP (standby mode). From the time T0 up to the time T1 the fusing roller 86 is decelerated to a relatively large degree and the pivot saddle 93 is moved relatively quickly in accordance with FIG. 8. From the time T1 to the time T2 which defines the limit position or position of rest of the fixing station, the pivot saddle 93 is pivoted back in a decelerated manner, specifically in accordance with the decelerated speed of the fusing roller 86. The paper speed VP determined by the print transfer station 17 is the difference of the paper transport speed VF determined by the fusing roller during the transportation away of the paper minus the paper speed VS of the reel paper 12 which is exposed during the pivoting away of the pivot saddle 93.

During this pivoting-away process of the pivot saddle 93, a slackness in the paper is produced between the print transfer station 17 and fusing roller 86, which slackness must be additionally transported away by the fusing roller 86 and thus the paper web is stripped off the fusing roller 86, specifically from the 60.degree. wrapping angle to a 0.degree. wrapping angle. The fusing roller must transport away paper (T0 to T1; T1 to T2) until the print transfer station 17 and the pivot saddle 93 no longer supply any paper. This occurs at the time T2. If this is the case, the speed of the reel paper 12 which is transported away from the fusing roller 86 must be zero. A reduction in the fusing roller speed during the stopping process with complete contact pressure applied, which reduction would be required to transport away the paper web 12, would result in a visisble overfixing of the printed image. This visible overfixing is avoided in that, simultaneously with the reduction in the fusing roller speed, from the times T0 to the time T2 the pivot saddle 93 is pivoted away in accordance with the characteristic visible in FIG. 8, and as a result the preheating distance (wrapping angle U) of the paper web is reduced.

During the stopping process, the transport of the paper in the fixing station 23 and the print transfer station 17 are to be matched to one another in such a way that as far as possible no movement takes place at the loop retractor 84. If this is the case, the stopping process, which is free of relative movement, has occurred between the printed image on the paper 12 and the fusing roller 86. For this, the following conditions which can be seen in FIGS. 8 and 9 must be fulfilled during the entire stopping process. With respect to the paper path (FIG. 9) these conditions are as follows:

$$SP=SF-SS$$

Here, SP is the paper path supplied by the print transfer station 17 in millimeters up to the stationary state of the paper at the time T1.

SS is the exposed paper path supplied by the pivot saddle 93 when the pivot saddle 93 pivots back from the position AB at the time T0 into the position CP at the time T2.

SF is the paper path in millimeters to be transported away by the fusing roller 86 up to the time T2 at which the pivot saddle 93 is in the position CP.

The paper speeds in the print transfer station 17, on the fusing roller 86 and on the pivot saddle 93 must be in the following relation to one another during the stopping process in accordance with the illustration in FIG. 8:

$$VP=VF-VS$$

Here, VP is the paper speed in the print transfer station. VS is the paper speed on the pivot saddle and VF the paper speed in the region of the fixing gap of the fusing roller 86.

During the stopping movement process of the print transfer station 17, fusing roller 86 and pivot saddle 93, the pressure between the feed roller 87 and fusing roller 86 is simultaneously reduced. Directly after the end of the stopping process (approx. 10 ms) after the time T2, the pressure is 0 and the two rollers 86 and 87 are separated from one another.

When this separating process is terminated, the entire paper web 12 is retracted by the paper transport in the print transfer station, specifically by a predetermined distance of for example 19/16" in order to be positioned for the following starting process.

The timing of the operations of print transfer station, fusing roller and pivot saddle during the starting process.

The characteristic of the paper movements caused by the fixing station 17, fusing roller 86 and pivot saddle 93 during the printer start is explained in greater detail below with reference to FIGS. 6 and 7.

The paper web 12 is located before the beginning of the starting process in the same state as at the time T2 after the end of the stopping process in FIGS. 8 and 9.

The EDP system coupled to the electrophotographic printer supplies information which is written on the photoconductive drum 16. The paper web is accelerated from the time T0 to T1 from 0 to the final speed, specifically in such a way that the toner image on the photoconductive drum 16 is moved synchronously with the paper web 12.

In the region of the print transfer station 17, the photoconductive drum 16 and paper web 12 are placed in contact with one another in such a way that a transfer of the toner image between photoconductive drum 16 and paper web 12 can take place. Before the paper transport is accelerated, 80% of the entire fixing pressure was obtained by pivoting together between the feed roller 87 and fusing roller 86. At the same time T0 at which the print transfer station begins to accelerate the paper web 12, the pivoting-on of the pivot saddle 93 out of the position CP (standby position) into the operating position AB also begins. In order to be able to carry out this pivoting-on process of the pivot saddle 93, the pivot saddle requires paper 12 from the print transfer station. In addition, at the time T0 the acceleration of the fusing roller 86 begins, which roller transports away the residual section of paper which was supplied in excess by the print transfer station 17. During the pivoting-on process of the pivot saddle 93 out of the position CP into the position AB from the time T0 to the time T3, the dependences which can be seen in FIGS. 6 and 7 between the paper transport elements of the print transfer station 17, the fusing roller 86 and the pivot saddle 93 must be fulfilled. This means that during the starting process the paper speed in the print transfer station 17 and in the fixing station 23 must be such that the loop retractor 84 does not move. If the loop retractor 84 is free of movement, a starting process which is free of relative movement occurs between the printed image on the paper 12 and the fusing roller 86. For this purpose, the following conditions must be fulfilled:

The paper path as a function of time (FIG. 7):

$$SPS=SFS+SSS$$

SPS=paper path in millimeters supplied by the print transfer station during the starting process (T0–T3)

SFS=paper path transported away by the fusing roller 86 during the starting process (time T0 up to the end of the starting process at time T3)

SSS=paper path (T0–T3) required during the starting process to pivot out the paper guide saddle 93.

Figure 6:
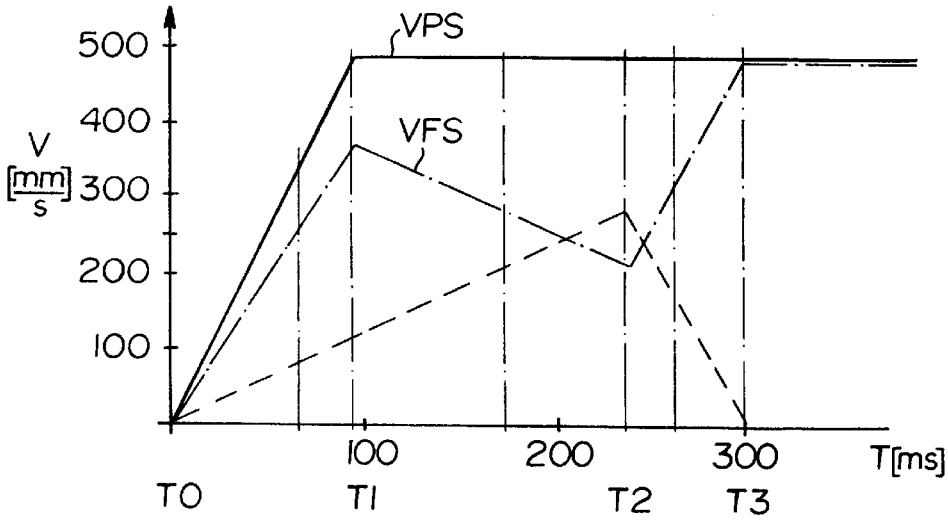
FIG. 6 shows a diagrammatic view of the paper transport speed V over the time T at the various units of the printer during the starting process.
Figure 7:
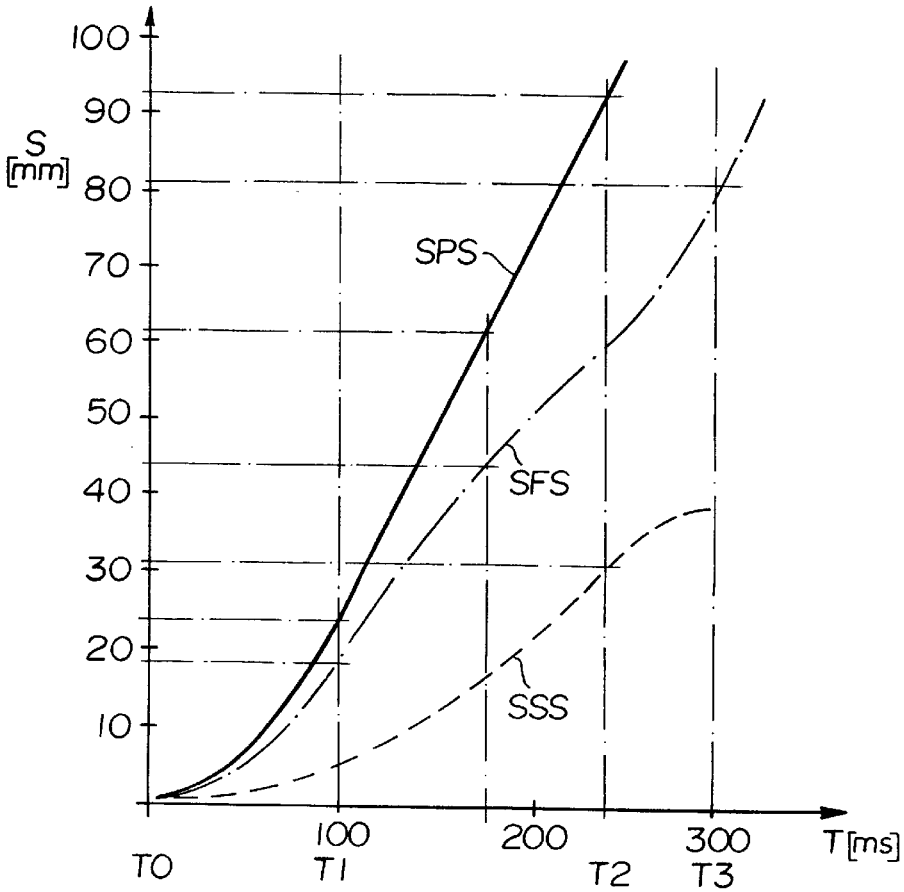
FIG. 7 shows a diagrammatic view of the paper path S of the recording medium which is supplied or transported away by the various units of the printer as a function of the time T during the starting process.

Analogously with the above, the relationship which can be seen in FIG. 6 is obtained for the paper speeds V during the starting process, the following condition having to be fulfilled for a starting process which is free of relative movement:

$$VPS=VFS+VSS$$

in which:

VPS=paper speed in the print transfer station 17

VFS=paper speed in the fixing gap

VSS=contribution to the paper speed by the pivot saddle 93 during the pivoting-on of the pivot saddle out of the position CP into the position AB from the time T0 to the time T3.

To summarize, the starting process occurs in accordance with the illustration in FIGS. 6 and 7 as follows:

At the time T0, the paper is accelerated in the print transfer station in accordance with the curve VPS up to the time T1, at the same time the pivot saddle 93 is pivoted on in accordance with the curve VSS and the fusing roller 86 is moved in accordance with the curve VFS. At the time T1, the paper 12 in the print transfer station 17 reaches the final speed, the pivot saddle 93 is moved outwards with continuing acceleration, the transportation away of the fixing station 23 of the paper provided is however decelerated by means of the fusing roller 86. At the time T2, the fixing station 23 is constantly fed with paper via the print transfer station 17. The pivoting-on of the pivot saddle 23 into the operating position AB is decelerated but the transportation away of the paper via the fusing roller 86 is accelerated again. At the time T3, the starting process is terminated and the electrophotographic printer is in the continuous printing mode.

As already explained, the control of the paper transport during printing and during the start/stop mode takes place by means of the drive arrangement D which is constructed as a microprocessor-controlled drive arrangement. The characteristic of the paper movements, which can be seen in FIGS. 6 to 9, during the stopping and starting process is stored in the memory of the microprocessor-controlled control arrangement and is called up out of the memory by the operator when a start or stop procedure is called up. The starting or stopping process then proceeds automatically under the control of the drive arrangement D.

The invention is not limited to the particular details of the apparatus and method depicted and other modifications and applications are contemplated. Certain other changes may be made in the above described apparatus and method without departing from the true spirit and scope of the invention herein involved. It is intended, therefore, that the subject matter in the above depiction shall be interpreted as illustrative and not in a limiting sense.

What is claimed is:

1. An apparatus to fix a toner image on an image carrier, comprising:

(a) a fusing roller and a feed roller, where the feed roller presses the image carrier against the fusing roller and the feed roller deforms to provide a nip, and the fusing roller hardly deforms at all, having no significant influence on nip width;

(b) the fusing roller including (i) a tubular core;

(ii) a thermally conductive silicon rubber forming a uniformly thick base layer on the core; and (iii) a wearable release coating on the base layer, the release coating having (A) a specific gravity between 1.1 and 1.4, (B) a tensile strength between 300 and 800 psi, (C) a hardness of between 35 and 60 shore A;

(c) a temperature controlling device is provided that receives signals from a temperature sensor for controlling temperature of the fusing roller to keep the temperature of the fusing roller at a roller surface thereof at a constant presettable temperature;

(d) a wrapping device for wrapping the image carrier around a portion of the fusing roller over a predetermined wrapping angle so that the image carrier is heated by the fusing roller not only at the nip but also over the entire wrapping angle.

2. The apparatus of claim 1, where the base layer is comprised of a plurality of sublayers of thermally conductive silicone rubber.

3. The apparatus of claim 1, wherein the base layer and the release layer are in a 1:1 ratio.

4. A procedure to fix a toner image on a toner receiver, comprising the steps of:

(a) with a fusing roller and an adjacent feed roller, providing a fixing gap for fixing the toner image by pressure and heat without relative movement between the toner receiver and the fusing roller, the fusing roller, having (i) a core, (ii) a base conductive cushion layer, and (iii) an outer release layer, where the release layer is sufficiently wearable to substantially preclude unintended retention of toner particles;

(b) controlling a surface temperature of the fusing roller depending upon a predeterminable reference value of the surface temperature;

(c) wrapping a continuous web of the image carrier according to a desired wrapping angle substantially greater than the fixing gap so that the toner image contacts the fusing roller surface over the entire wrapping angle, said wrapping angle depending on the surface temperature of the fusing roller and transport speed of the image carrier; and (d) pressing the image carrier between the feed roller and the fusing roller where the feed roller deforms to provide a nip, and the fusing roller hardly deforms at all, the fusing roller having no significant influence on nip width.

5. The procedure of claim 4, wherein the outer wearable release layer of the fusing roller has the properties:

(a) a specific gravity between 1.1 and 1.4, (b) a tensile strength between 300 and 800 psi, (c) a hardness of between 35 and 60 shore A.

6. The procedure of claim 4, wherein the wearable release layer of the fusing roller has a thickness between 0.05 mm and 0.3 mm.

7. The procedure of claim 4, wherein the wearable release layer of the fusing roller has a thickness between 0.2 mm and 0.3 mm.

8. The procedure of claim 4, wherein the wearable release layer of the fusing roller has a thickness of approximately 0.25 mm.

9. The procedure of claim 4, where the roughness of the surface of the fusing roller is between Rz2 and Rz10.

10. The procedure of claim 4, where the roughness of the surface of the fusing roller is Rz6.

11. The procedure of claim 4, wherein the outer wearable release layer of the roller is GE TSE-322 or equivalent.

12. The procedure of claim 4, wherein the base conductive cushion layer of the roller is Dow Corning Silastic 8990 compound or equivalent.

13. An apparatus for fixing a toner image by pressure and heat on a side of a recording medium, comprising:

(a) a fixing station having a fusing roller, comprised of:
  (i) a tubular core;
  (ii) a cushion layer having a substantially uniform thickness disposed on the core;
  (iii) a wearable release layer on the cushion layer, the release layer having a thickness between approximately 0.7 and approximately 1.3 times the thickness of the cushion layer; and (b) a feed roller, which presses the recording medium against the fusing roller at a fixing gap so that the toner image on the recording medium is in contact with the fusing roller under heat and pressure.

14. The apparatus of claim 13, where (a) the fusing roller's core is aluminum (b) the base layer is thermally conductive silicon rubber; and (c) The wearable release coating on the base layer has
  (i) a specific gravity between 1.1 and 1.4,
  (ii) a tensile strength between 300 and 800 psi,
  (iii) a hardness of between 35 and 60 shore A.

15. The apparatus of claim 13, wherein:

(a) the fixing station has a wrapping device for wrapping the recording medium around a portion of the fusing roller over a predetermined wrapping angle so that the recording medium is heated by the fusing roller not only at the fixing gap but also over the entire wrapping angle; and (b) the material wrapping device can change the wrapping angle between a standby position and an operating position.

16. An apparatus according to claim 13, wherein a temperature controlling device is provided which receives signals from a temperature sensor positioned at the fusing roller for controlling temperature of the fusing roller to keep the temperature of the fusing roller at a roller surface thereof at a constant presettable temperature.

17. An apparatus according to claim 13, wherein a temperature of the fusing roller is set by a temperature controlling device as a function of different operating parameters.

18. The apparatus according to claim 13, wherein an oiling device applies oil to the fusing roller.

19. An apparatus according to claim 13, wherein the temperature sensor provides a contactless measurement of the surface temperature.

20. An apparatus according to claim 13, wherein the surface of the roller is coated with silicone oil with a viscosity of at least 500 cst.

21. An apparatus according to claim 13, wherein the surface of the roller is coated with silicone oil with a viscosity of approximately 10,000 cst.

22. An apparatus for fixing a toner image by pressure and heat on a front side of an image carrier, which already has a fixed toner image on a rear side without said already fixed toner image on the rear side being smudged or destroyed, comprising:

(a) an electrothermal fixing station having a fixing gap between a thermally heated fusing roller and a feed roller for accepting the image carrier therebetween such that said toner image to be fixed contacts the fusing roller by pressure of the feed roller against the rear of the image carrier to fix the toner image without relative movement between the image carrier and the fusing roller;

(b) the fusing roller, comprised of:
  (i) a core;
  (ii) a cushion layer having a substantially uniform thickness disposed on the core;
  (iii) a wearable release layer on the cushion layer, the release layer having a thickness between approximately 0.7 and approximately 1.3 times the thickness of the cushion layer; and (c) a temperature controlling device for detecting a surface temperature of the fusing roller and to control a heater of said fusing roller depending on a predetermined reference value of said surface temperature so as to keep the surface temperature of the fusing roller at a constant presettable temperature; and (d) an image carrier wrapping device for wrapping ta continuous web of image carrier about the fusing roller over a wrapping angle such that the toner image to be fixed contacts said fusing roller surface over said entire wrapping angle, said wrapping angle depending on the surface temperature of said fusing roller and transport speed of the image carrier.

* * * * *

UNITED STATES PATENT AND TRADEMARK OFFICE

CERTIFICATE OF CORRECTION

PATENT NO. : 6,298,216 B1
DATED : October 2, 2001
INVENTOR(S) : McMindes, Michael et al.

It is certified that error appears in the above-identified patent and that said Letters Patent is hereby corrected as shown below:

Title page,
Item [73], Assignee, name reading "Ten Cate Enbi, Inc.", should read as -- Ten Cate Enbi International bv and OCE Printing Systems GmbH --.

Signed and Sealed this

Twenty-fifth Day of March, 2003

JAMES E. ROGAN
*Director of the United States Patent and Trademark Office*